US005333482A

United States Patent [19]

Dunlap et al.

[11] Patent Number: 5,333,482

[45] Date of Patent: Aug. 2, 1994

[54] METHOD AND APPARATUS FOR FLATTENING PORTIONS OF A CORRUGATED PLATE

[75] Inventors: Donald L. Dunlap, Pekin; Douglas R. Ervin, Metamora, both of Ill.

[73] Assignee: Solar Turbines Incorporated, San Diego, Calif.

[21] Appl. No.: 968,653

[22] Filed: Oct. 30, 1992

[51] Int. Cl.[5] ..... B21D 22/10; B21D 13/02

[52] U.S. Cl. ..... 72/307; 72/379.6; 72/312; 72/414; 29/890.03; 226/166

[58] Field of Search ..... 72/307, 385, 379.6, 72/414, 407, 312; 29/890.03, 890.039; 226/166, 165

[56] References Cited

U.S. PATENT DOCUMENTS

| | | | |
|---|---|---|---|
| 1,462,475 | 7/1923 | Atkinson . | |
| 2,221,464 | 11/1940 | Zahodiakin | 192/127 |
| 3,748,889 | 7/1973 | Miller et al. | 72/382 |
| 3,759,323 | 9/1973 | Dawson et al. | 165/166 |
| 3,845,654 | 11/1974 | Fuller et al. | 72/381 |
| 4,022,050 | 5/1977 | Davis et al. | 72/379 |
| 4,114,253 | 9/1978 | Loomis | 29/753 |
| 4,275,581 | 6/1981 | Miller | 72/385 |
| 4,434,637 | 3/1984 | Bailey | 72/17 |

FOREIGN PATENT DOCUMENTS

| | | | |
|---|---|---|---|
| 2029528 | 1/1971 | Fed. Rep. of Germany . | |
| 2703694 | 8/1977 | Fed. Rep. of Germany . | |
| 1461560 | 2/1989 | U.S.S.R. | 72/307 |
| 412146 | 6/1934 | United Kingdom | 226/166 |

*Primary Examiner*—Daniel C. Crane
*Attorney, Agent, or Firm*—Joseph W. Keen

[57] ABSTRACT

A method and apparatus is provided for crushing a portion of a corrugated plate in a selected area of the corrugations without blocking the grooves. In accordance with the method teeth are inserted into grooves on opposite sides of the corrugated plate and the corrugation ridges associated with such grooves are, axially adjacent such insertion, crushed to a predetermined thickness. The teeth are then withdrawn, the corrugated plate is indexed a desired number of ridges/grooves and the die members are again engaged with the opposite sides of the plate. The apparatus for crushing a plate includes a frame for supporting the plate, a feed apparatus for moving the plate at the desired time in the desired direction, and a forming apparatus for crushing plate ridges in a zone and obstructing, in a transition zone between the crushed ridges and the uncrushed ridges, ridge transverse movement into adjacent grooves.

21 Claims, 8 Drawing Sheets

METHOD AND APPARATUS FOR FLATTENING PORTIONS OF A CORRUGATED PLATE

DESCRIPTION

1. Technical Field

This invention relates generally to a method and apparatus for forming a metal plate and, more particularly, to a method and apparatus for crushing to a predetermined extent selected ridge portions on a corrugated plate while maintaining the associated grooves in an open configuration in the zone between the crushed and uncrushed ridge portions.

2. Background Art

Thin, corrugated metal plate is used in a variety of applications and, depending upon the application, may require a portion of the corrugation ridges to be flattened or crushed. An example of an application where such selective corrugation crushing is useful is heat recovery apparatus such as primary surface recuperators. The corrugation grooves on opposite sides of a metal plate serve to direct the flow of relatively warm and cool fluids with heat being transferred directly through the plate between the fluids. Peripheral portions of several such plates are suitably welded together to prevent the relatively warm and cool fluids from intermixing.

Before the plates are assembled, selected portions of the plates' ridges are crushed to provide flattened header sections which will facilitate the manifolding of fluids and render their handling more feasible. These header or manifolds sections at each end of the plate receive or deliver the fluid from or to an appropriate passage of the recuperator assembly.

A stacked plate heat exchanger of the type described herein is illustrated in U.S. Pat. No. 3,759,323. In fabricating heat exchangers of that type, difficulties have been encountered in flattening the header sections. Such header sections extend transversely to the corrugation ridges/grooves, and as the ridges in the header sections are flattened, the ridges expand transversely and often completely or at least partially block the transversely adjacent corrugation grooves which act as fluid passageways. Various attempts to mitigate this problem have been attempted but each have, in some respect, been found to be less than totally satisfactory.

U.S. Pat. No. 4,434,637 has two, inter-engaging die members of desired axial length to maintain the corrugation grooves in a substantially open configuration while crushing the associated ridges to the desired thickness for an axial length equal to the die's axial length- Subsequently, when the ridge portions which are axially adjacent the previously crushed ridge portions are, in turn, crushed, the crushed thicknesses of the plate are equivalent and, thus, there is no blockage of the corrugation grooves therebetween. The ridge portions axially adjacent the initially crushed ridge portions, however, are transversely deformed as a result of the initial crushing so as to extend into and at least partially obstruct the corrugation grooves transversely adjacent such crushed ridges.

U.S. Pat. No. 4,022,050 describes a method of manufacturing a corrugated plate and technique for crushing a portion of the corrugations. Such patent, however, does not, during crushing of selected ridge portions, guide deformation of the ridge portions axially adjacent such crushed ridge portions to maintain transversely adjacent grooves in an open channel configuration, U.S. Pat. Nos. 1,462,475, 3,748,889, 3,845,654, and 4,275,581 are all illustrative of the general field of forming corrugated metal plates but do not show or suggest means for crushing a portion of the corrugation ridges while maintaining the corrugation grooves axially adjacent such crushed ridge portion in an open configuration.

DISCLOSURE OF THE INVENTION

In one aspect of the present invention, a method for flattening a portion of ridges on a corrugated plate while maintaining the corrugation grooves in an open configuration between the crushed and uncrushed ridge portions is provided. The corrugation ridge flattening method includes feeding a plate having corrugation ridges in a first direction with the ridges being arranged in a second, transverse direction, crushing a desired length of the ridges to a predetermined thickness, and guiding ridge deformation axially adjacent the crushed ridge length to prevent ridge deformation in the first direction. The deformation guiding preferably includes controllably tapering the height of the ridges in a transition zone between the crushed ridge portions and the full height ridge portions. The method also preferably includes biasing the plate against movement in the first and second directions during crushing and releasing such biasing during feeding of the plate in the first direction.

In another aspect of the present invention, an apparatus is provided for crushing a portion of a plates' corrugation ridges while maintaining corrugation grooves axially and transversely adjacent such crushed ridge portion in a substantially open configuration- The crushing apparatus includes a frame for supporting a corrugated plate, a feed mechanism for moving the plate in a first direction, apparatus for crushing a portion of the corrugation ridges to a predetermined height and for guiding deformation of the corrugation ridge portions axially adjacent the crushed portion to prevent ridge transverse deformation, and means for driving the feed mechanism and the crushing/deformation guiding apparatus- The foregoing and other aspects of the invention will become apparent from the following detailed description of the invention when considered in conjunction with the accompanying drawings.

BEST MODE FOR CARRYING OUT THE INVENTION

Figure 1:
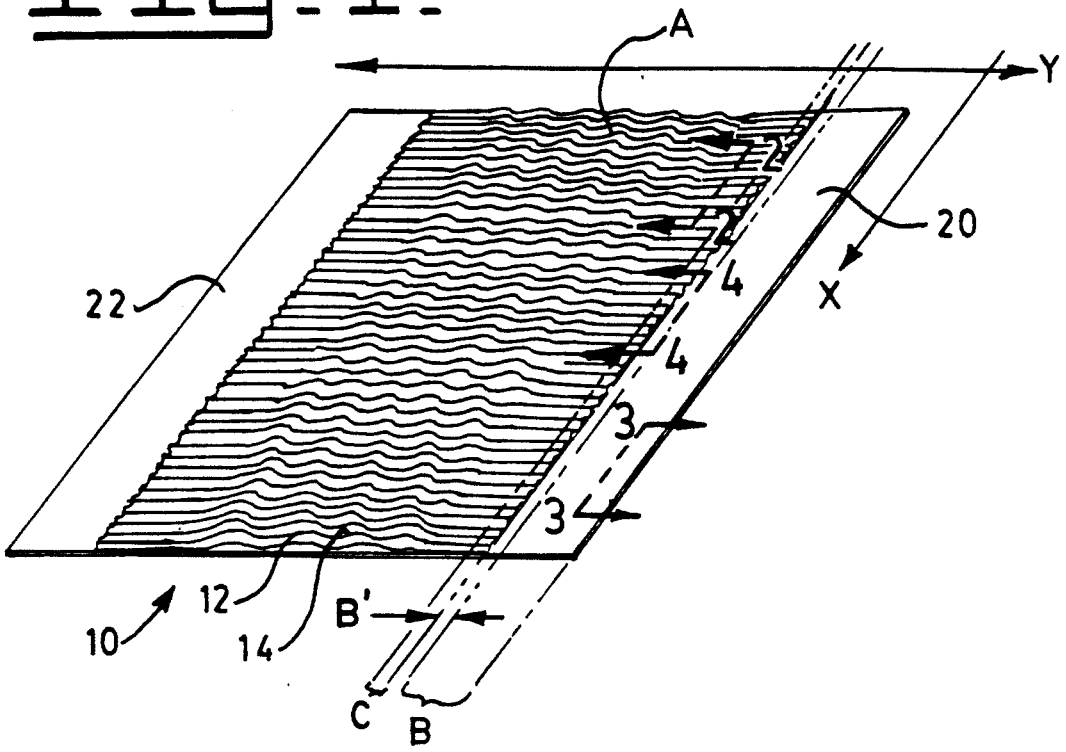
FIG. 1 is a diagrammatic view of a corrugated plate having a portion of its corrugation ridges flattened.
Figure 2:
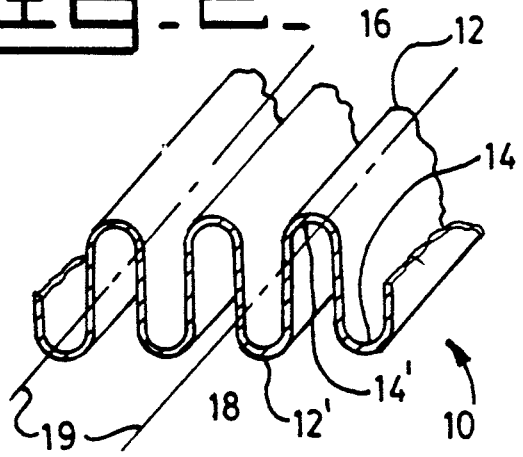
FIG. 2 is a sectional view taken along line II—II of FIG. 1.
Figure 3:
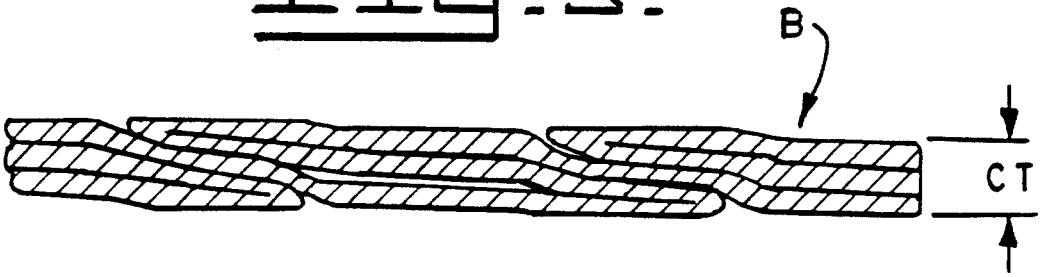
FIG. 3 is a sectional view taken along line III—III of FIG. 1.

Referring now to the drawings in detail, a corrugated metal plate 10 is shown in FIG. 1 and includes alternating corrugation ridges 12 and grooves 14 as better illustrated in FIG. 2. Of course, the ridges 12 and grooves 14 from the perspective of a viewer above the plate 10 at 16, constitute grooves 14' and ridges 12' respectively when viewed from a vantage point below the plate 10 such as at 18. Each ridge and groove has a longitudinal axis 19 as best seen in FIG. 2. The illustrated ridges 12,12' and grooves 14,14' are, except for regions near the margins of sheet 10, actually sinusoidally arranged about the axes 19 as viewed from above 16 or below 18 of the plate but such arrangement is not required for purposes of the present invention. The ridges and grooves in such margin regions are not sinusoidally arranged to facilitate insertion of die members as will be discussed hereafter.

The illustrated plate 10, by example, constitutes one element of a heat exchanger. Such heat exchanger is made up of many of the plates 10 with relatively warm and cool fluids passing on opposite sides 16 and 18 of each plate such that relatively cool fluid flowing on either side 16 or 18 will directly absorb heat from the relatively warm fluid flowing on the opposite side 16 or 18 of the plate 10. The fluid advantageously passes axially along grooves 14 on side 16 and along grooves 14' on side 18. The fluid, whether relatively warm or cool, is operatively transmitted into a distribution header for distribution into the grooves 14 and for collection in another collection header after passing through grooves 14. It is, of course, to be understood that such headers will be formed when two plates 10 are advantageously welded together or otherwise joined so that fluid transmitted into the distribution header will only be directed through the grooves 14 and subsequently into the collection header for return to a desired location.

Typically, such plates 10 are formed by means well known in the art and are subsequently adapted to specific applications such as the above described heat exchanger plate. When a plate 10 has corrugations thereon which constitute ridges 12 and 12' and grooves 14 and 14', it is necessary to flatten such ridges in the header regions 20 and 22 to form, after joining two such plates 10 together, distribution and collection headers for the fluid(s). An undeformed corrugation ridge portion is represented in FIG. 1 as full height zone A. A primary crush zone B is illustrated in FIG. 1 and constitutes the area of plate 10 where most of the corrugation ridge crushing occurs. A secondary crush zone B' is illustrated in FIG. 1 and is advantageously associated with a transition zone C disposed axially between zone A and zone B'. It is to be understood that the crushed thickness of zone B is substantially equal to that of zone B' which will be discussed herein in cooperation with the transition zone C for reasons that will be apparent at the time of description.

Figure 4:
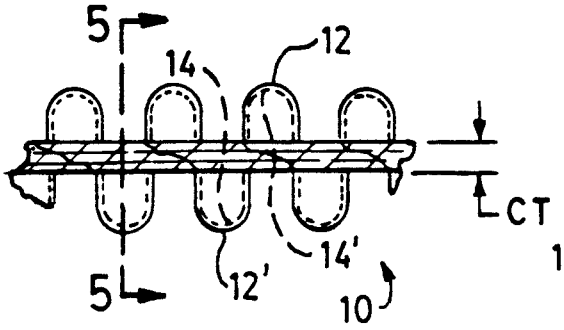
FIG. 4 is sectional view taken on line IV—IV of FIG. 1.

FIG. 4 is a sectional view taken along the lines IV—IV in FIG. 1 illustrating an end view of the crush zone B' and transition zone C.

Figure 5:
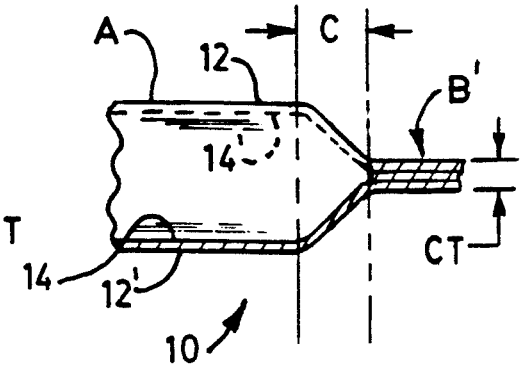
FIG. 5 is a sectional view taken along lines V—V of FIG. 4.

FIG. 5 is a sectional view illustrating the plate portion 10 as viewed along line V—V of FIG. 4. As is apparent, the secondary crush zone B' has a crush thickness CT and the ridges 12,12' and associated grooves 14,14' taper from the plate's full height zone A through transition zone C to crush thickness CT at secondary crush zone B'.

Figure 6:
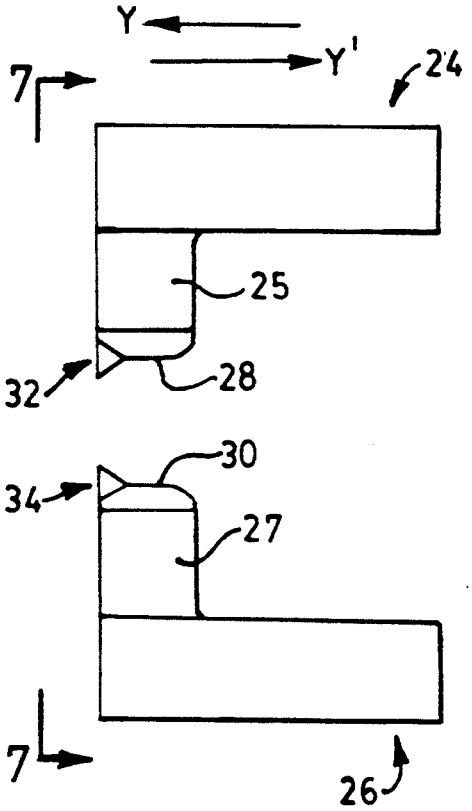
FIG. 6 is a elevational view of first and second, separated die members.
Figure 7:
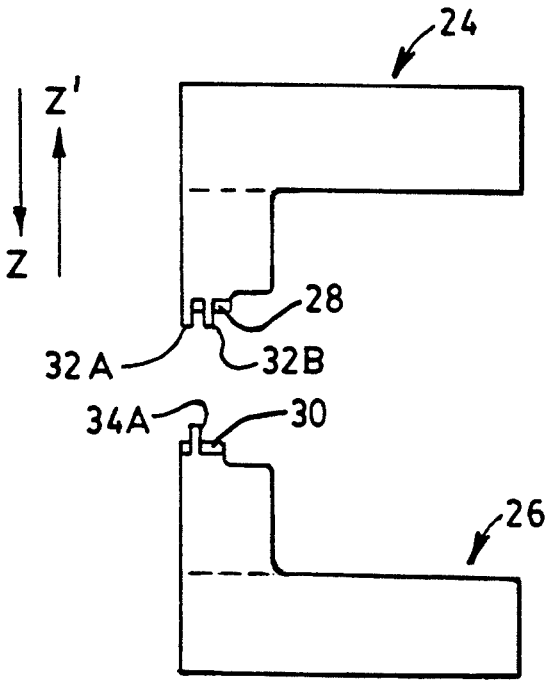
FIG. 7 is a side view of the die members shown if FIG. 6.

FIGS. 6 and 7 each illustrate a first or upper die member 24 and a second, or lower die member 26 in their operative, separated positions and having respective crush surfaces 28 and 30 disposed on their adjacent sides. The first die member 24 has a first guide set (32) which includes a pair of teeth 32A and 32B and the second die member 26 has a second guide set (34) which includes single tooth 34A with the teeth being disposed on the adjacent sides of the die members. It is to be understood, however, that the upper and lower die members 24,26 may have greater crush surface lengths/greater number of teeth than shown with the optimum length/number being a function of the plate's toughness/maleability, the percentage of crush desired, the power available to perform the secondary crush, and the precision used in forming the corrugation ridges and grooves. By example, the preferred number of teeth (with the crush length corresponding thereto) for the application described herein is two and three, respectively, on the upper and lower die members 24,26.

Figure 8:
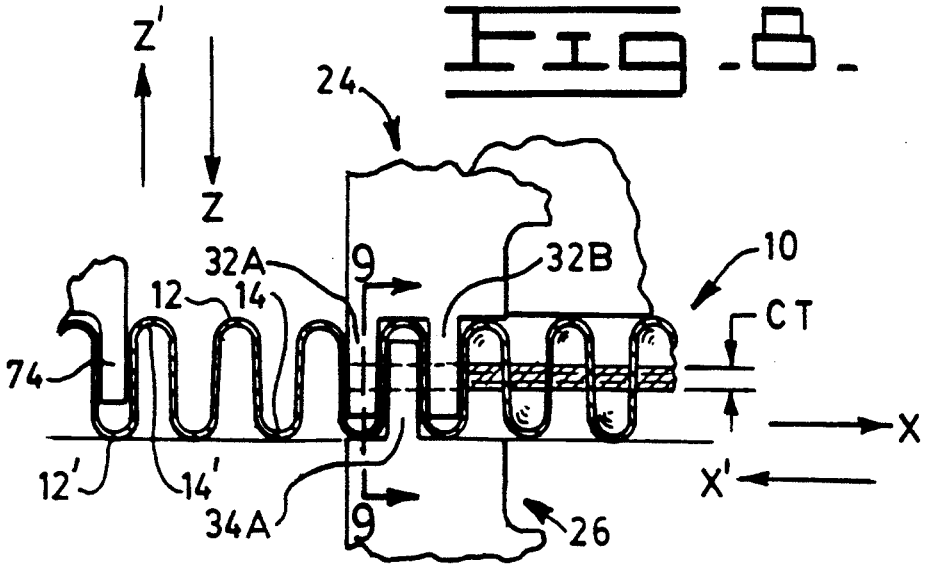
FIG. 8 is a diagrammatic view of the die members and an interposed corrugated plate from the vantage point of FIG. 7 but with the die members in engaged relationship with each other.

FIG. 8 illustrates an enlarged view of the dies members 24,26 in their operative, engaged positions from the same perspective as FIG. 7 but with a corrugated plate 10 disposed therebetween. The crush surfaces 28 and 30, best illustrated in FIG. 6, are not visible in FIGS. 7 and 8 but it is to be understood that in FIGS. 7 and 8 the crush surfaces are generally behind the teeth 32A, 32B, 34A.

Figure 9:
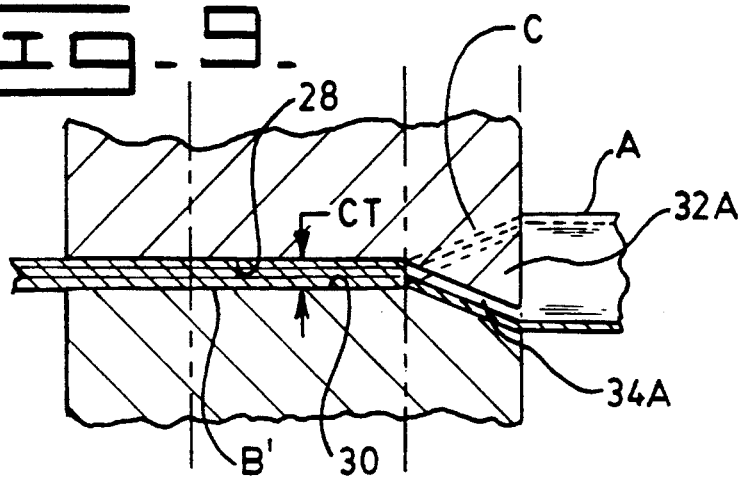
FIG. 9 is a sectional view taken along line IX—IX of FIG. 8.

FIG. 9 is a sectional view taken along line IX—IX in FIG. 8 and illustrates the plate's undeformed corrugation ridge full height zone A, the transition zone C, the secondary crush zone B' primary crush zone B, and the crushed thickness CT.

Figure 10:
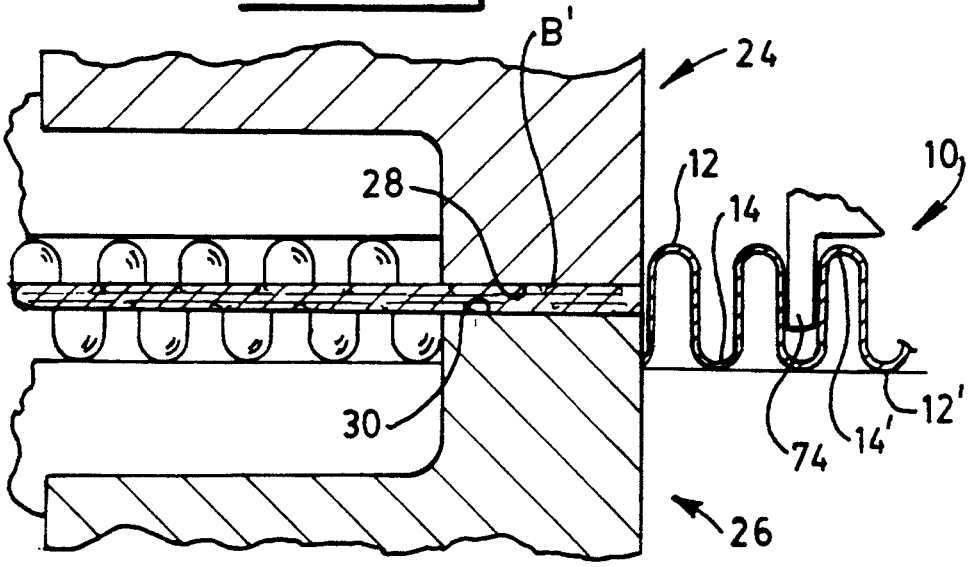
FIG. 10 is a diagrammatic view illustrating the same apparatus as FIG. 8 except from the opposite side thereof.

FIG. 10 is identical to FIG. 8 except it is viewed from the opposite side of the perspective for FIGS. 7 and 8. The crush surfaces 28 and 30 are best seen in FIG. 10 in engagement with the secondary crush zone B' of the plate 10.

Figure 11:
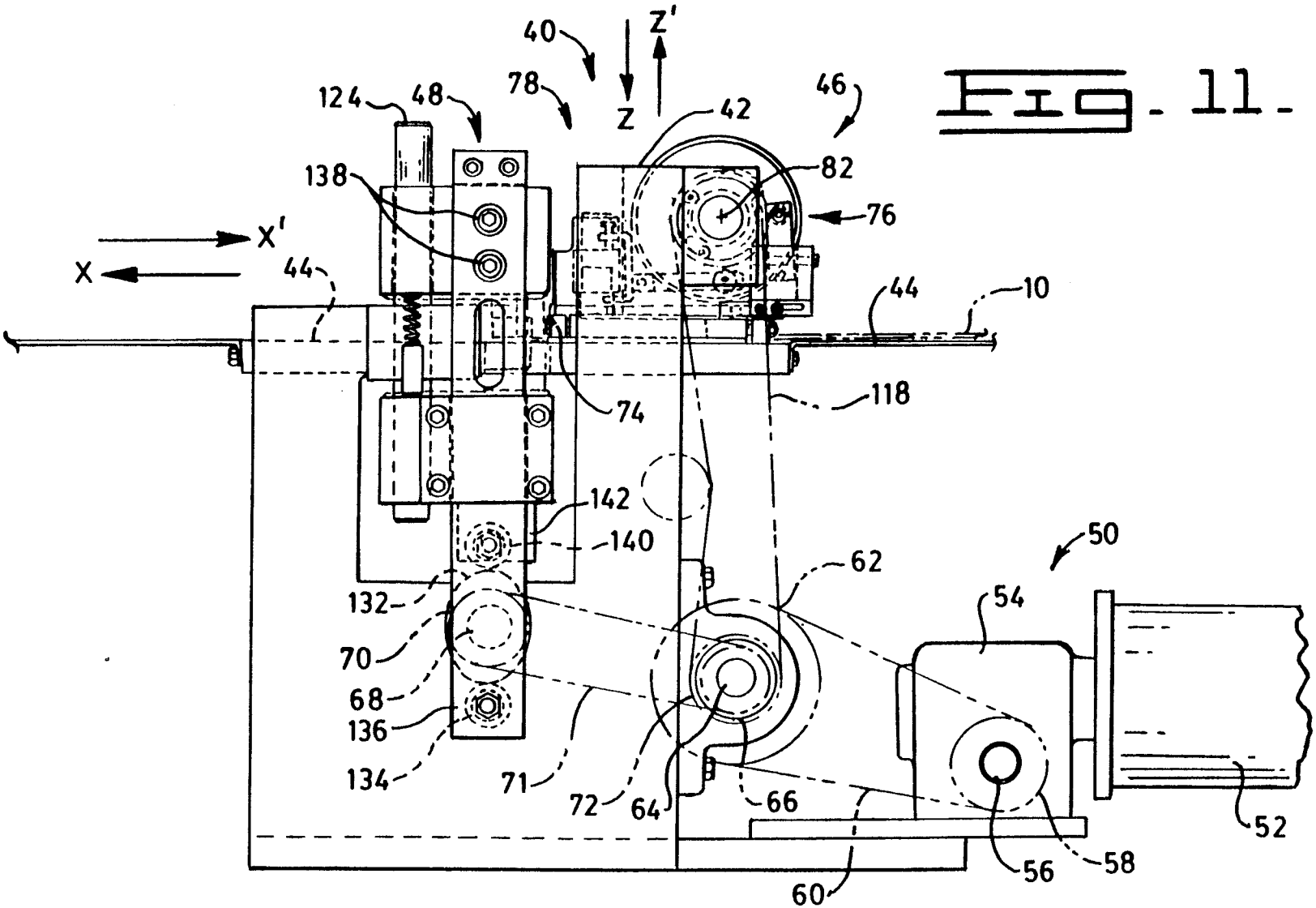
FIG. 11 is an elevational view of an apparatus which employs the die members illustrated in FIGS. 6 and 7 to crush corrugated plate fed therethrough.

FIG. 11 illustrates a fabrication apparatus 40 which actuates the first and second die members 24,26 and feeds the corrugated plate 10 in a first direction X between the die members. The fabrication apparatus 40 generally includes a frame 42 having a table 44 which supports the plate 10, a feed apparatus 46 for sequentially moving the plate 10 in the X direction, forming means 48 for crushing and guiding deformation of corrugation ridges in the secondary crush zone B' and the transition zone C respectively, and means 50 for driving the feed apparatus 46 and the forming means 48.

Driving means 50 generally includes an electric motor 52 having an output shaft (not shown), a transmission 54 being drivingly connected to the motor's output shaft and includes an output shaft 56, a pinion gear 58 mounted on shaft 56 to rotate therewith, a chain 60 entrained about and engaged with the pinion gear 56 and a gear 62 which is mounted on and rotatable with a shaft 64 journaled at either end in the frame 42, a gear 66 fixed to and rotatable with the shaft 64, a second shaft 68 journaled at its ends in the frame 42, a gear 70 which is mounted on and adapted to rotate with shaft 68, a chain 71 entrained about and engaged with gears 66 and 70, and a gear 72 mounted on and rotatable with the shaft 64 outboard of the journaling frame 42.

Figure 12:
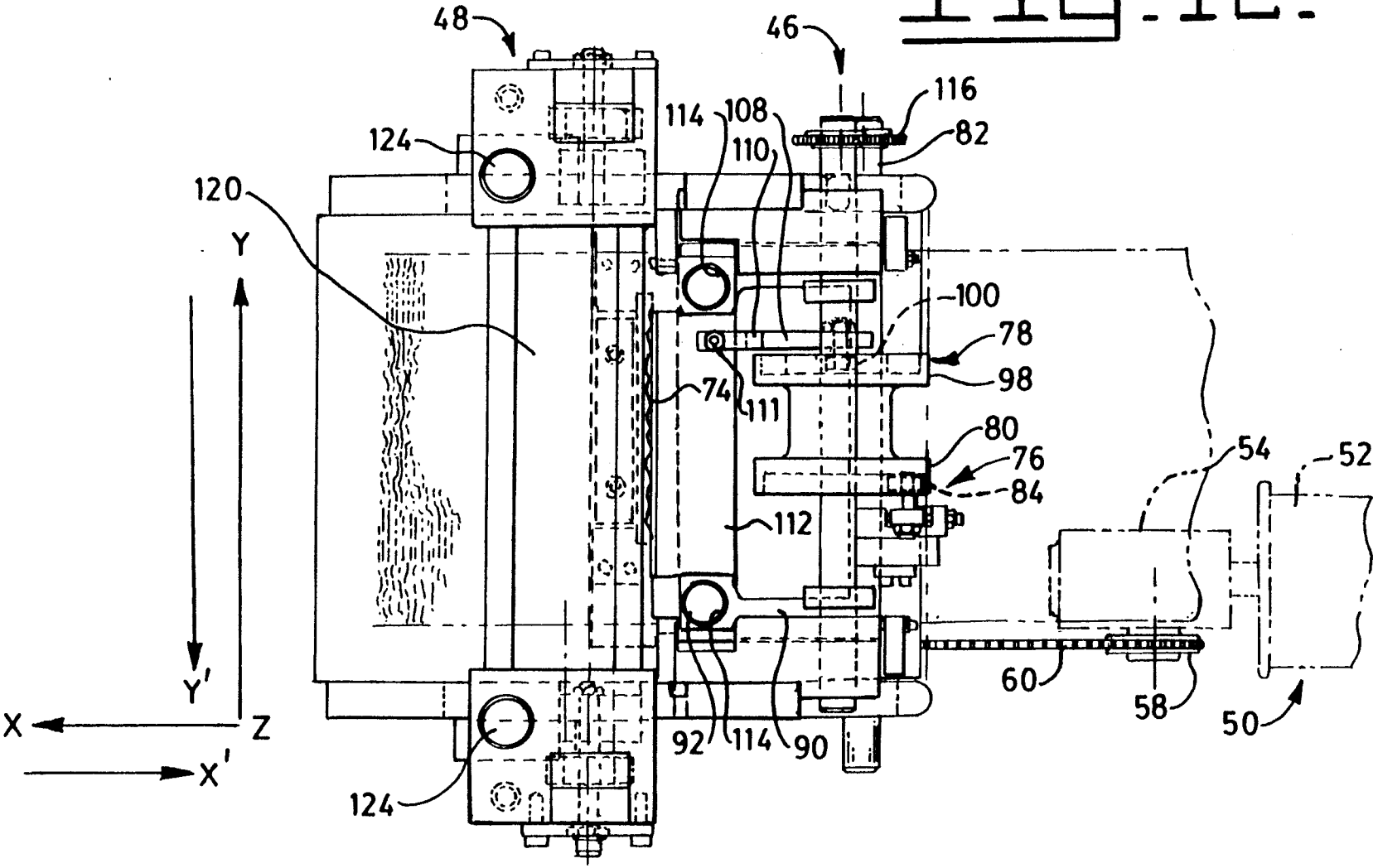
FIG. 12 is a plan view of the apparatus shown in FIG. 11.
Figure 14:
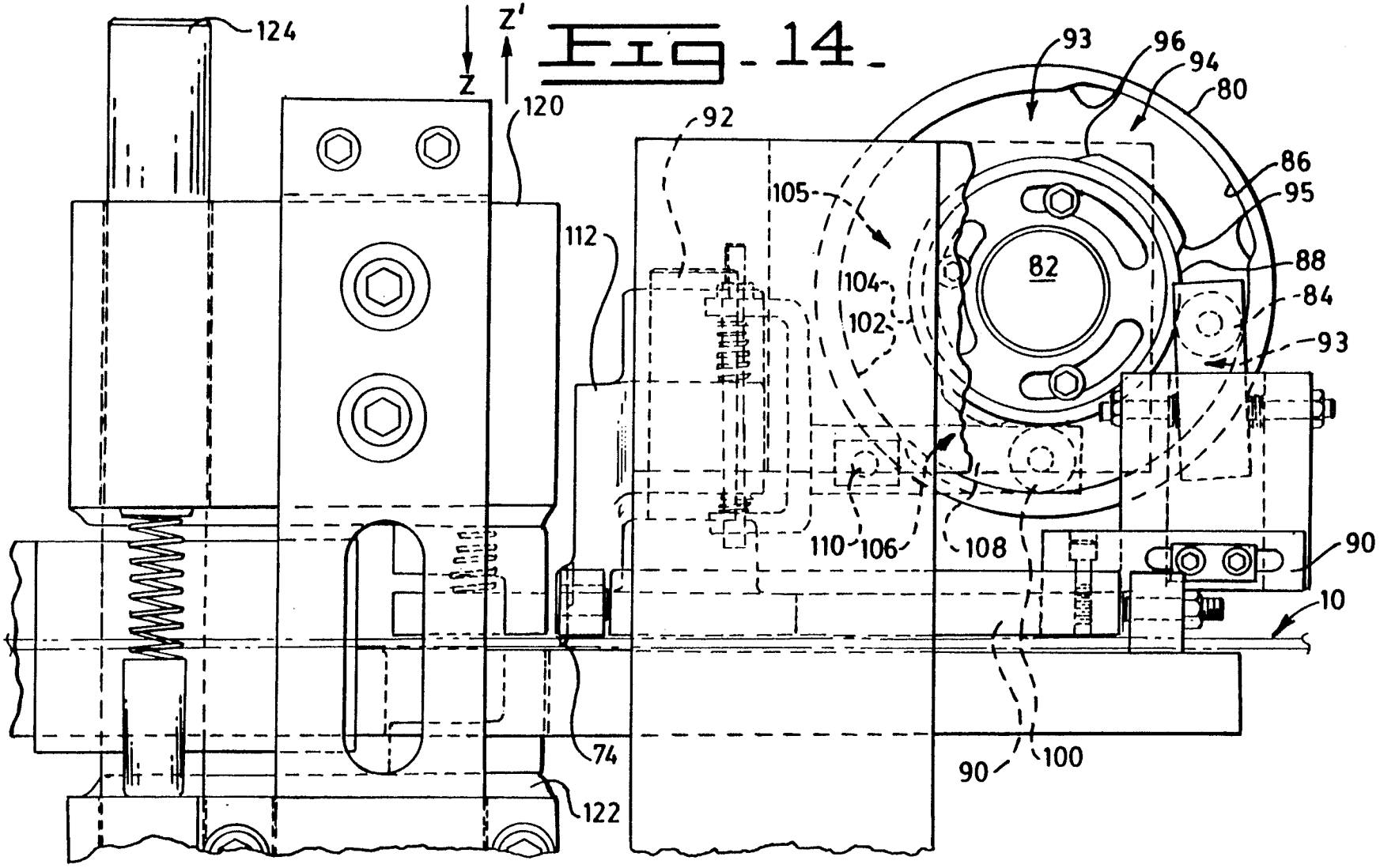
FIG. 14 is an enlarged elevational view of a portion of the apparatus shown in FIG. 11.

The feed apparatus 46 includes a feed blade 74 which is selectively insertable in any groove 14 of the plate 10, a horizontal feed actuation apparatus 76 for moving the feed blade 74 in the first or X direction and the opposite or X' direction, and a vertical actuation apparatus for moving the feed blade 74 in a third or Z direction into any desired groove 14 and the opposite direction Z' out of any desired groove. The feed blade 74 is shaped to mate with the grooves 14 and, as best seen in FIG. 12, is sinousoidally shaped in the illustrated case to mate with the sinousoidally shaped grooves 14. The horizontal feed actuation apparatus 76 includes a first cam 80 mounted on a shaft 82 to rotate therewith, a cam follower 84 which is disposed to run in contact with the first cam's first and second cam surfaces 86 and 88, and a feed table 90 which, as best illustrated in FIG. 14, extends in the Z direction from the cam follower 84 and in the X direction. Opposite ends of the shaft 82 are journaled in the frame 42. A pair of leader pins 92 are fixed to the feed table 90, extend upwardly therefrom in the Z' direction, and are disposed on opposite ends of plate 10 adjacent the manifold regions 20 and 22.

Cam surfaces 86,88 are separated a distance substantially equal to the diameter of the cam follower 84 and engage opposite sides thereof. The cam surfaces have, as best seen in FIG. 14, a forward region 93 and a rearward region 94 where the cam surfaces are near and far, respectively, from the centerline of the shaft 82. Horizontal actuation regions 95 and 96 constitute portions of the cam surfaces which respectively join the forward to rearward regions and the rearward to forward regions when the cam 80 is rotated clockwise as viewed in FIG. 14.

The vertical actuation apparatus 78 includes a cam 98 mounted on and being adapted to rotate with shaft 82 and a cam follower 100 disposed between and engageable with parallel cam surfaces 102 and 104 formed on the cam 98. Cam surfaces 102,104 include insertion region 105 and withdrawal region 106 which are respectively near and far from the center of the cam 98. A feed rocker arm 108 is joined at opposite ends to the cam follower 100 and a feeder bar 112 and, intermediate the ends, is pivotally connected to a pivot pin 110 which is fixed to the frame 42. The feeder bar 112 has a pair of openings 114 therein for receiving the leader pins 92.

The cam follower 100 moves from the insertion region 105 to the withdrawal region 106 during clockwise rotation of the cam 98 causing the feed rocker arm 108 to pivot about the pivot pin 110 and move the feeder bar 112 and joined feed blade 74 in the Z' direction away from the corrugated plate 10. Of course, when the cam follower 100 moves from the withdrawal region 106 to the insertion region 105, the feeder bar 112 again rests on the front edge of the feeder table 90. A drive gear 116 is mounted on and rotatable with the shaft 82 and is, with gear 72, entrained within chain 118.

Figure 13:
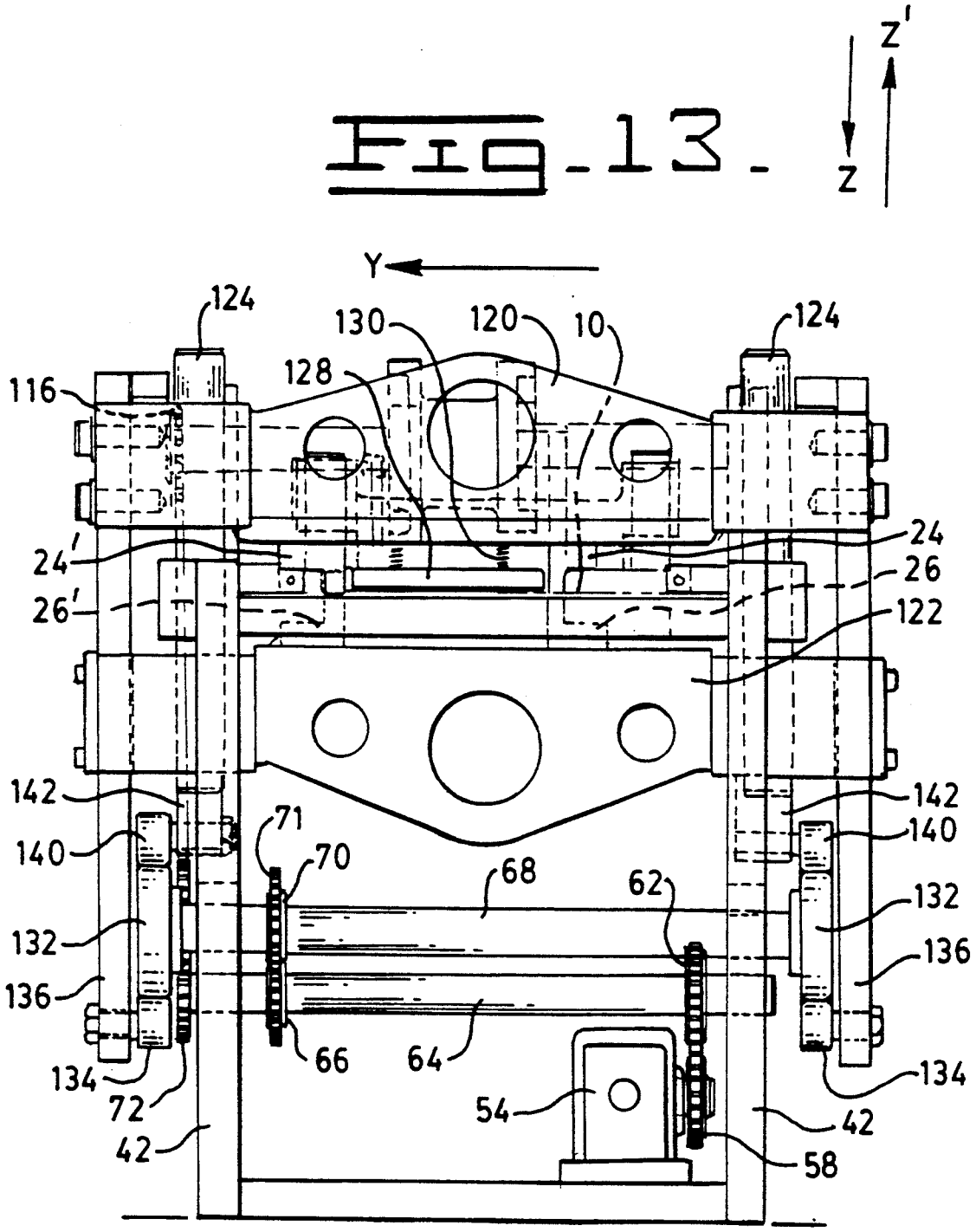
FIG. 13 is a side elevational view of the apparatus shown in FIG. 11.

Forming means 48 includes an upper forming bridge 120, a lower forming bridge 122, and a pair of forming leader bars 124 which are fixed to the frame 42 and received in holes in the upper and lower forming bridges 120,122 for guiding same in the Z and Z' directions. Forming means 48 also includes the upper and lower die members 24,26 which are respectively attached to and supported by the upper forming bridge 120 and the lower forming bridge 122. Although FIG. 13 illustrates the die members 24,26 being generally arranged along the right edge of the forming apparatus 46, it is to be understood that such die members may be installed at the locations indicated in phantom in FIG. 13 by reference numerals 24' and 26' or may be installed at both the illustrated and phantom locations. A spring bar 128 and a pair of springs 130 also constitutes a portion of the forming means 48. The spring bar 128 is joined to a lower surface of the upper bridge 120 and is biased by the springs 130 toward the lower forming bridge 122 and, if a plate 10 is interposed therebetween, toward side 16 of corrugated plate 10.

As best seen in FIG. 11, driving means 50 further includes a cam 132 attached to each end of and rotatable with the shaft 68, a cam follower 134 engageable with each cam 132 and an upper bridge forming actuator 136 which is attached to and extends upwardly from each cam follower 134 and is fixedly attached by bolts 138 or other fastening means to the upper forming bridge 120. The driving means 50 also includes a cam follower 140 engaged with each cam 132, a lower forming actuator 142 which is joined to the cam follower 140 and the lower forming bridge 122. The cams 132 and the hereinabove described apparatus associated with each are disposed on opposite lateral sides of the forming bridges 120,122 as best seen in FIG. 13.

Figure 15:
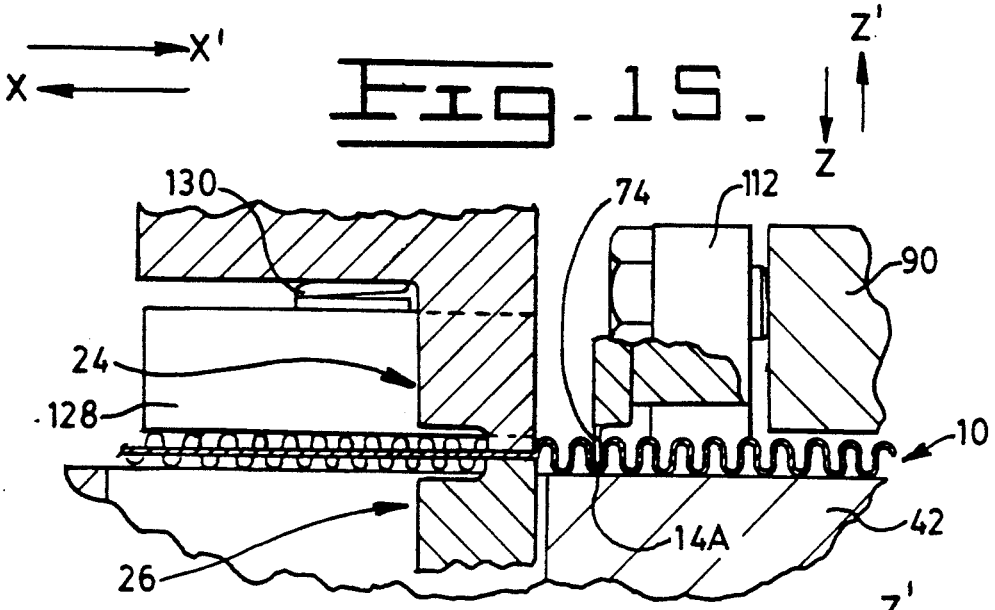
FIGS. 15 through 17 are partial sectional views of the apparatus illustrated in FIG. 10 illustrating sequential operation.
Figure 16:
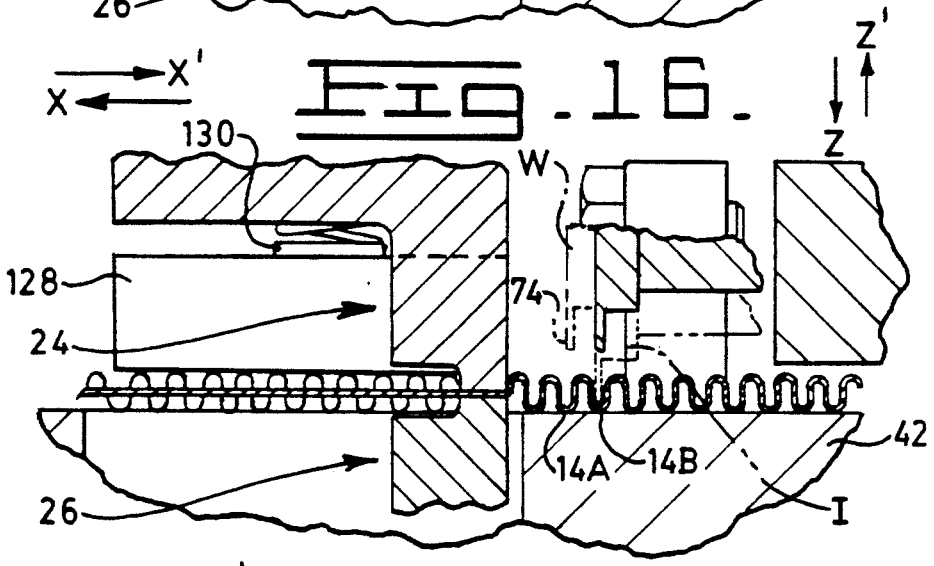
Figure 17:
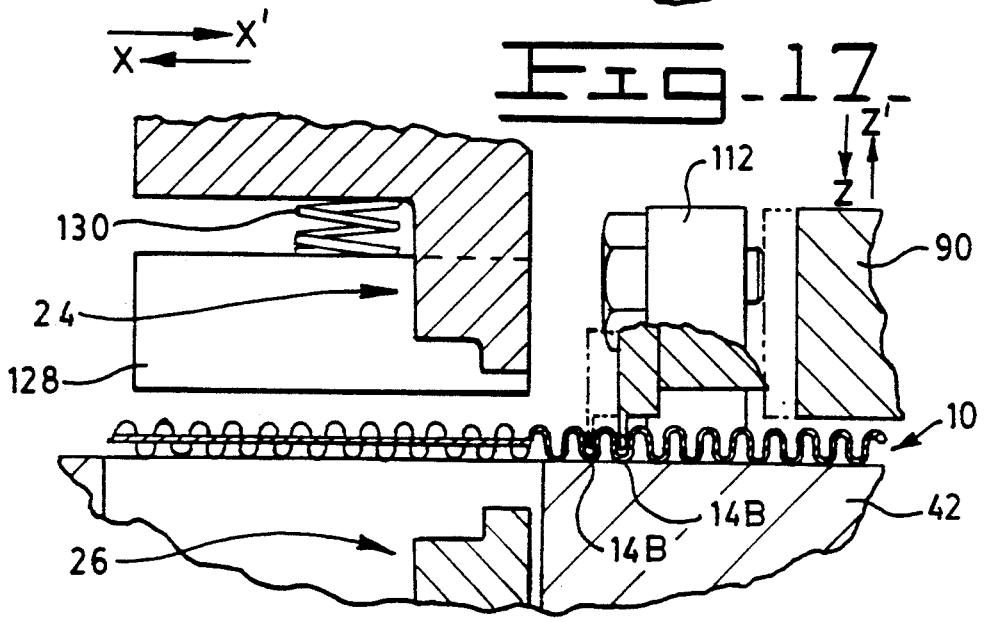

FIGS. 15–17 illustrate various cooperative configurations assumed by portions of the forming means 48 and feed apparatus 46 during a complete cycle of crushing a corrugated ridge 12 on the upper surface 16 of the plate 10 and a pair of corrugated ridges 12' on the lower surface 18 of the plate 10. FIG. 15 illustrates the die members 24,26 in forming/crushing engagement with the plate 10, the spring bar 128 in securing engagement with the upper surface 16 of the plate 10 as is apparent from the compressed configuration of springs 130, and the feed blade 74 in feeding engagement with a groove 14A in the upper surface 16 of the plate 10 and said feeder bar 112 being engaged with the horizontal feeder table 90.

FIG. 16 illustrates the feed blade 74: withdrawn from the groove 14A (withdrawn position shown in phantom); disposed one groove pitch in the X' direction; and (again in phantom) inserted into the another groove 14B. The groove 14B is, when plate 10 is fed in the X direction, the next groove 14 engaged by feed blade 74 after groove 14A was engaged by the feed blade 74 as shown in FIG. 15.

FIG. 17 illustrates the upper and lower die members 24,26 and spring bar 128 having been disengaged and withdrawn from the plate 10. The feed blade 74 is shown engaged with the groove 14B (identical to the phantom, inserted position of FIG. 16). The feed blade 74 illustrated in the phantom position in FIG. 17 has moved and has caused the plate 10 to move in the X direction to align the next corrugation ridges 12,12' between the die members 24 and 26 for subsequent crushing and deformation guiding. After the feed blade 74 assumes the configuration illustrated in phantom in FIG. 17, the spring bar 128 is driven downwardly in the Z direction into engagement with the top 16 of the plate 10 under biasing action of the spring 130. Upon engagement of the spring bar 128 with the plate 10, the upper bridge 120 and attached die member 24 continue to move downwardly toward the plate 10 in the Z direction while the lower die 26 continues to move upwardly in the Z' direction toward side 18 of the plate 10 until the crushing and guiding deformation of the interposed corrugated ridges 12,12' have been completed as shown along the left side of FIG. 15. Thereafter, the cycle repeats the steps sequentially illustrated and described in FIGS. 15–17.

INDUSTRIAL APPLICABILITY

The motor 52, when actuated, drives the transmission 54, gear sprocket 58 and all the gears, chains, and cams described hereinbefore. The corrugated plate 10 is preferably fed in the X direction one ridge 12,12' at a time by the feed apparatus 46. It is, however, to be understood that by suitably adjusting the cam surfaces of cams 80 and 98 and providing a commensurately greater number of forming teeth on guide sets 32 and 34, the plate 10 could be fed in the X direction any number of corrugation ridges 12,12' at a time. However, for purposes of illustrating the operation of the forming apparatus 40, the illustrated and described feed apparatus 46 and forming means 48 will be referenced.

The apparatus 40 repetitively performs a series of operations which illustrate the method described herein. Such series of operations is sometimes referred to as the crushing cycle and a description of such cycle necessitates the selection of some point in the cycle as the beginning for such description. Such beginning is arbitrarily chosen where the apparatus 40 is in the operative configuration illustrated in FIG. 11. Each cam 132 as illustrated in FIG. 11 occupies a position wherein the engaged cam followers 134 and 140 are the maximum distance from the center 68 of cam 132. FIG. 15 shows, with greater clarity, the relative positions of portions of the forming means 46 and feed apparatus 46 of FIG. 11 wherein the die members 24,26 are engaged with opposite sides 16 and 18, respectively, of plate 10 to crush the corrugation ridges 12,12' in the plate's secondary crush zone B' to the thickness CT and maintain the grooves 14,14' in an open, unblocked configuration in the transition zone C. At the same time, the spring bar 128 is fully engaged with the upper surface 16 of corrugated plate 10 under maximum compressive biasing of the springs 130 so as to restrain movement of plate 10 during engagement of die members 24,26 with the plate. The feed blade 74 is stationary within the groove 14A prior to and during spring bar 128 engagement with the plate.

After the illustrated die engagement in FIGS. 15 and 16, the feed blade 74 is withdrawn to the phantom position illustrated as W in FIG. 16 by actuation of the vertical actuator apparatus 78. Such actuation occurs as a result of clockwise rotation (as viewed in FIG. 14) of cam 98 until cam follower 100 moves from the insertion region 104 to the withdrawing region 106 causing the feed rocker arm 108 to pivot about the pivot pin 110 and move the feed bar 112 and joined feed blade 74 in the Z' direction away from the corrugated plate 10. Of course, when the cam follower 100 moves from the withdrawal region 106 to the insertion region 104, the feeder bar 112 again rests on the front edge of the feeder table 90. Thereafter, the feed blade 74 is moved in the X' direction through suitable actuation of the horizontal feed actuator 76 until the feed blade 74 occupies the solid, sectioned configuration shown in FIG. 16. Such actuation occurs as a result of clockwise rotation of cam 80 until cam follower 84 is moved in the X' direction through the horizontal actuation region 95 causing feeder table 90 and associated feed blade 74 to also move in the X' direction. Thereafter, the feed blade 74 is inserted into the groove 14B directly below the solidly illustrated configuration by suitable actuation of the vertical actuator apparatus 78. Such actuation occurs as a result of clockwise rotation of cam 98 until cam follower 100 moves from the withdrawal region 106 to the insertion region 104 causing feed rocker arm 108 to pivot about pin 110 and move the feeder bar 112 and joined feed blade 74 in the Z direction and into groove 14B.

Thereafter, the upper and lower forming bridges 120,122 are respectively moved in the Z' and Z directions away from the upper and lower surfaces 16,18 of the corrugated plate 10 until the die members 24,26 and the spring bar 128 mounted on such forming bridges occupy the positions shown in FIG. 17. During such forming bridge movement, the upper and lower die members 24,26 disengage from the plate 10 prior to the spring bar 128 disengaging from the plate 10. After the spring bar 128 has completely disengaged from the plate 10 as shown in FIG. 17, the horizontal feed actuating apparatus 76 moves the feed blade 74 from the position illustrated in solid lines in FIG. 17 to the position illustrated in phantom in FIG. 17 causing the corrugated plate 10 to advance in the X direction by one or more desired number of grooves 14. Such movement occurs as a result of rotation of cam 80 until cam follower 84 is moved in the X direction through the horizontal actuation region 96 causing feeder table 90 and associated feed blade 74 to also move in the X direction.

After occupying the positions illustrated in FIG. 17, the upper and lower forming bridges 120,122 are moved toward one another in the Z and Z' directions, respectively, to cause the spring bar 128 to engage the plate 10 under biasing force from the springs 130 before die members 24 and 26 engage sides 16 and 18, respectively, of the plate 10 to crush and guide deformation of the ridges 12,12' in a controlled manner. When the die members 24,26 have completed the crushing/ridge guiding deforming, the feed blade 74 and forming apparatus again occupy the position illustrated in FIG. 15. The cycle illustrated in FIGS. 15–17 is repeated until the desired number and portion of corrugation ridges 12,12' have been crushed and guided to provide the crush zone B' and transition zone C. Typically thereafter, the primary crush zone B is formed in any manner well known in the art to deform the ridges 12,12' to the same crush height CT. It is to be understood, however, that the ridge crushing in primary crush zone B may precede the crushing and deformation guiding of the present invention in the secondary crush zone B' and transition zone C, respectively.

The pressure drop of fluid flowing through the grooves 14,14' of the plate 10 formed in the manner described herein is approximately one half that experienced for fluid flow in conjunction with a plate 10 formed with prior art techniques wherein there was no ridge deformation guiding in the transition zone C. Such pressure drop reduction improves the thermodynamic performance and efficiency of the utilizing heat exchanger.

It should now be apparent that the described method and apparatus enable crushing of corrugation ridges 12,12' (and, of course, the associated grooves 14,14') in such manner as to obstruct deformation thereof into adjacent grooves and minimizing the pressure drop of fluid flowing through the grooves 14,14' between the manifold regions 20 and 22.

We claim:

1. Method for crushing a portion of a corrugated plate's corrugations comprising:

feeding a corrugated plate having first and second, opposed sides with alternating ridges and grooves therein a predetermined distance in a first direction, said first direction being transverse to a second direction which is parallel to the axis of the ridges and grooves;

engaging a pair of the corrugation grooves on the first side and a corrugation groove on the second side in a transition zone with a first and second die member, respectively;

crushing a ridge disposed between the engaged groove pair and associated with the single engaged groove to a predetermined height in a crush zone said crush zone being adjacent said transition zone in said second direction, with said transition zone being formed with corrugations gradually extending from said predetermined height of said crush zone to a full height of the corrugations which have not been deformed; and guiding deformation of the ridge by said first and second die members in a direction parallel to the second direction in the transition zone to form said gradually extending corrugations.

2. The method of claim 1 further comprising:

tapering the height of the ridge and groove associated therewith in the transition zone.

3. The method of claim 1 wherein said engaging, crushing, and guiding occur simultaneously.

4. The method of claim 1 wherein said engaging is also performed on a second groove on the second side, said crushing is also performed on a secondary ridge disposed between the engaged grooves on the second side.

5. The method of claim 1 wherein said feeding comprises:

inserting a feed blade into a groove; and moving said feed blade in the first direction.

6. The method of claim 5 wherein, during engagement of the plate, said feed blade is sequentially inserted into and withdrawn from one groove and a different groove, respectively.

7. The method of claim 1 wherein said predetermined distance equals a selected number of groove pitches.

8. The method of claim 1, further comprising:

biasing the plate against movement in the first and second directions during crushing.

9. The method of claim 8, further comprising:

releasing said biasing during feeding of the plate in the first direction.

10. An apparatus for flattening a portion of the corrugation ridges on a corrugated plate comprising:

a frame including a table for supporting a corrugated plate having corrugation ridges and grooves;

a feed apparatus for moving the plate in a first direction including a feed blade, a horizontal feed actuation apparatus for moving said feed blade in the first direction, and a vertical actuation apparatus for selectively moving said feed blade into and out of selected grooves;

forming means for crushing portions of said ridges and for guiding deformation of other portions of the ridges, said forming means including means for crushing, in a third direction and a fifth direction both of which directions are transverse to the first direction, corrugation ridge portions to a predetermined height in a crush zone and guiding means for guiding ridge deformation ;from ridge crushing in a second direction, transverse to the first and third directions, in a transition zone extending between the crush zone and a full height zone where said ridge portions have not been deformed so that the transition zone has corrugations gradually extending from said crush zone to said full height zone; and means for driving said feed apparatus and said forming means.

11. The apparatus of claim 10, said horizontal feed actuation apparatus comprising:

a rotatable first cam having a first and a second cam surface;

a first cam follower engageable with said first and second cam surfaces and being displaceable in the first direction and in a fourth direction opposite said first direction between a first and a second position; and means for joining said first cam follower to said feed blade.

12. The apparatus of claim 10, said vertical actuation apparatus comprising:

a rotatable cam having a third and a fourth cam surface;

a cam follower engageable with said third and fourth cam surfaces and being displaceable in said third and a fifth direction opposite said third direction between a third and a fourth position; and means for joining said cam follower to said feed blade.

13. The apparatus of claim 12, said joining means comprising:

a feeder bar attached to said feed blade;

a pivot pin mounted on the frame; and a feed rocker arm attached to said feed bar and said second cam follower and pivotally attached to said pivot pin.

14. The apparatus of claim 13 further comprising:

means for guiding the movement of said feeder bar in the third and fifth directions.

15. The apparatus of claim 13 further comprising:

means for biasing said feeder bar in the third direction into engagement with said plate's grooves.

16. The apparatus of claim 10, said forming means comprising:

a first and a second die member with which said crushing means and said guiding means are cooperatively associated; and means for engaging said first die member with laterally adjacent grooves on one side of the plate and for engaging said second die member with a groove on the opposite side of the plate between said laterally adjacent grooves.

17. The apparatus of claim 16, said crushing means comprising:

a first and a second crush surface respectively disposed on the first and second die members and a third and a fourth guide set respectively disposed on the first and second die members, said first and second crushing surfaces being respectively disposed adjacent said third and fourth guide sets in the second direction, said third guide set including first and second teeth disposable in first and second laterally adjacent grooves and said fourth guide set including a third tooth disposable in a groove on the opposite side of the plate laterally between said first and second grooves.

18. The apparatus of claim 17 wherein said teeth taper from the adjacent crush surface to the undeformed height of the ridges.

19. The apparatus of claim 16, said driving means further comprising:

a rotatable cam;

a pair of cam followers engageable with said rotatable cam and being displaceable equal distances in the third direction and a fifth direction by said rotatable cam; and means for respectively joining said cam followers to said engagement means.

20. The apparatus of claim 10 wherein said feed apparatus and guiding means are actuated to sequentially cause: the feed apparatus to move the plate in the first direction; the crushing means to crush; the feed apparatus to withdraw the feed blade from the engaged groove in a fifth direction opposite that of the third direction; the feed apparatus to move the feed blade in a fourth direction opposite the first direction; the feed apparatus to insert the feed blade into another groove; and the crushing means to disengage from the plate.

21. The apparatus of claim 16, said forming means further comprising:

a spring bar for engaging the plate prior to and after said die members respectively engage and disengage the plate; and means for biasing said spring bar toward the plate.

* * * * *